United States Patent [19]

Baird, Jr.

[11] 4,007,111

[45] Feb. 8, 1977

[54] RESIDUA DESULFURIZATION AND HYDROCONVERSION WITH SODAMIDE AND HYDROGEN

[75] Inventor: William Chalmers Baird, Jr., Baton Rouge, La.

[73] Assignee: Exxon Research and Engineering Company, Linden, N.J.

[22] Filed: Apr. 28, 1975

[21] Appl. No.: 571,946

[52] U.S. Cl. ..... 208/108; 208/157; 208/209; 208/230; 208/251 H; 208/264; 208/289; 252/438; 252/439; 252/476

[51] Int. Cl.[2] ..... C10G 13/06; B01J 27/24

[58] Field of Search ..... 208/108–112, 208/208 R, 208 M; 264/209, 226; 289/230, 235

[56] References Cited

UNITED STATES PATENTS

| | | | |
|---|---|---|---|
| 1,729,943 | 10/1929 | Hofsass | 260/667 |
| 1,937,914 | 12/1933 | Pines | 208/230 |
| 3,470,086 | 9/1969 | Jones | 208/209 |
| 3,787,315 | 1/1974 | Bearden et al. | 208/208 M |
| 3,788,978 | 1/1974 | Bearden et al. | 208/208 M |
| 3,791,966 | 2/1974 | Bearden et al. | 208/208 M |

*Primary Examiner*—Herbert Levine
*Assistant Examiner*—G. E. Schmitkons
*Attorney, Agent, or Firm*—Edward M. Corcoran

[57] ABSTRACT

Sulfur-containing petroleum oil feedstocks which include heavy hydrocarbons constituents undergo simultaneous desulfurization and hydroconversion by contacting such feedstocks with sodamide in the presence of hydrogen and at elevated temperatures. The mixture of reaction products resulting from the above procedure can be separated to give sodium sulfur salts and a petroleum oil product which has been substantially desulfurized and demetallized and significantly upgraded as demonstrated by a reduced Conradson carbon content and an increased API gravity.

19 Claims, 1 Drawing Figure

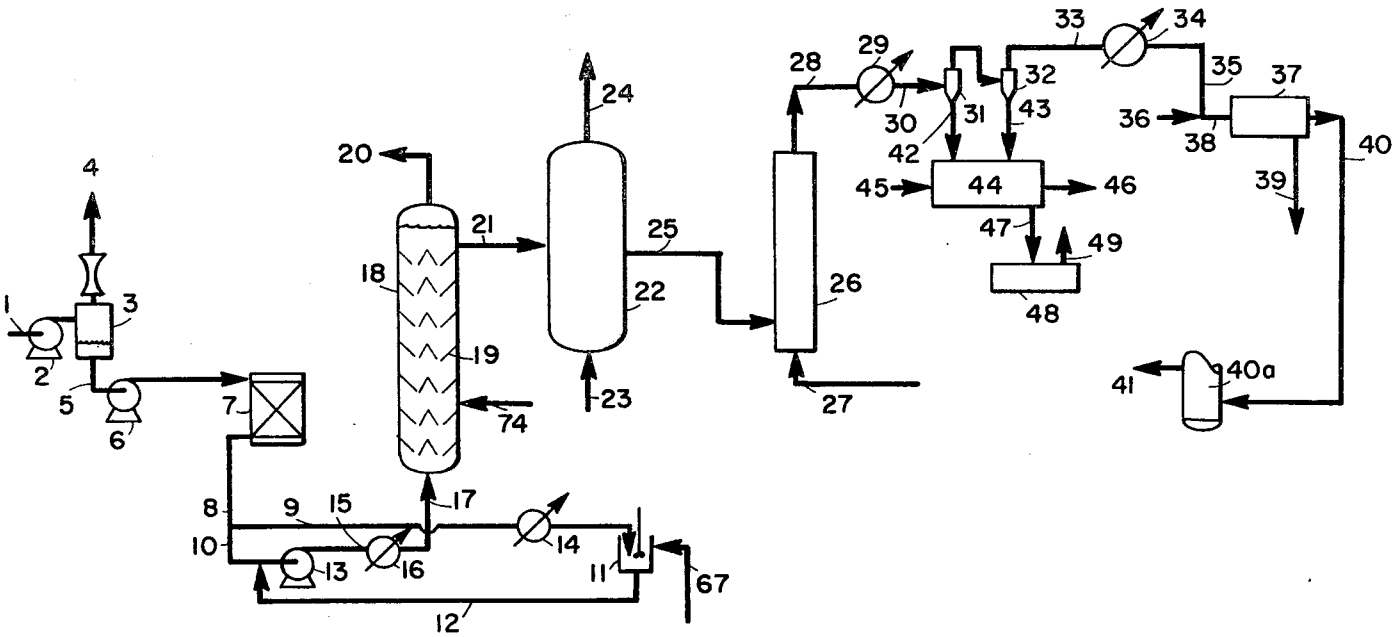
1
2
3
4
5
6
7
8
9
10
11
12
13
14
15
16
17
18
19
20
21
22
23
24
25
26
27
28
29
30
31
32
33
34
35
36
37
38
39
40
40a
41
42
43
44
45
46
47
48
49
67
74

RESIDUA DESULFURIZATION AND HYDROCONVERSION WITH SODAMIDE AND HYDROGEN

FIELD OF THE INVENTION

This invention relates to the combined desulfurization and hydroconversion, and consequent upgrading, of sulfur-bearing hydrocarbon feedstocks by contacting the feedstock with sodamide in the presence of hydrogen and at elevated temperatures.

DESCRIPTION OF THE PRIOR ART

The problem of air pollution, particularly with regard to sulfur oxide emissions, has been of increasing concern to refiners. As a consequence, the development of efficient as well as economic means for the removal of sulfur from sulfurbearing fuel oils has become a primary research goal in this industry. Presently, the most practical desulfurization process is the catalytic hydrogenation of sulfur containing molecules in petroleum hydrocarbon feeds to effect the removal of these sulfur molecules as hydrogen sulfide. The process generally requires relatively high hydrogen pressures, e.g., from about 700 to 3000 psig and temperatures in the range of from about 650° to 800° F, depending on the feedstock and the degree of desulfurization. Also, these proceses do not effect the simultaneous desulfurization and hydroconversion of the feedstocks employed, and particularly not without a high degree of coke make during same.

The catalytic process is thus generally quite efficient in the handling of distillates but becomes more complex and expensive and less efficient as the feedstock becomes increasingly heavier, e.g., whole or topped crudes and residua, Thus, for example, a residuum feedstock is often times contaminated with heavy metals, e.g., nickel, vanadium, iron, and asphaltenes which tend to deposit on and deactivate the catalyst. Also, the sulfur is generally contained in high molecular weight molecules that can be broken down only with the aid of severe operating conditions. Such operating conditions, however, tend to accelerate catalyst deactivation due to the accelerated deposition of coke and metals on the catalyst surfaces.

It has also long been known that sodium and other alkali metals and hydroxides exhibit desulfurization activity for residua, but even so suffer from distinct drawbacks, such as, poor desulfurization efficiency, a tendency to produce oil insoluble sludges, the inability to upgrade the feedstock by demetallization, and the formation of salt-oil mixtures that are exceedingly difficult to resolve by conventional means. Furthermore, again, none of these materials has ever been employed to obtain simultaneous desulfurization and substantial hydroconversion of the feedstocks being treated. Recently, however, U.S. Pat. No. 3,788,978 disclosed new means for the resolution of desulfurized oil-sodium salt mixtures and U.S. Pat. No. 3,787,315 disclosed that sodium treatment in the presence of low pressure hydrogen improved sodium efficiency (i.e., the amount of sodium required to remove a given amount of sulfur), demetallization, and elimination of sludge formation.

It has also been suggested to employ sodamide as a desulfurization reagent. For example, U.S. Pat. No. 1,937,914 discloses the treatment of hydrocarbon oils with sodamide wherein the oils to be treated are vaporized and bubbled through, or otherwise contacted with molten sodamide at a temperature of 500° to 510° F. The use of sodamide for the deep desulfurization and simultaneous hydroconversion of hydrocarbon feeds is not, however, suggested in any of this prior art. In addition, sodamide is normally regarded as useful for dehydrohalogenation or certain condensation reactions, but not for the desulfurization and/or hydroconversion of hydrocarbon feeds.

It has now been found that where sodamide is employed in the presence of hydrogen to react with sulfur-bearing petroleum oil feedstocks, at elevated temperatures, the feedstock undergoes desulfurization and demetallization while simultaneously, heavy hydrocarbon constituents of the feedstock undergo hydroconversion to lighter, lower boiling components. Thus, in effect, the use of sodamide in conjunction with hydrogen as described herein provides a combined and simultaneous desulfurization and hydroconversion function, which may be effected in an efficient and economical manner.

SUMMARY OF THE INVENTION

In accordance with the present invention, an efficient combined desulfurization, hydroconversion and feed upgrading process is provided, wherein sulfur-bearing petroleum oil feedstocks, for example whole or topped crudes and residua containing heavy hydrocarbon constituents, are contacted in a reaction zone, preferably while in the liquid phase, with sodamide, at temperatures ranging from about 400° to about 2000° F, and in the presence of sufficient added hydrogen to provide a pressure within the range of from about 150 to about 5000 psig. The reaction products produced as a result of the above contacting comprise a highly desulfurized and significantly upgraded petroleum oil, and various sodium sulfur salts, for example, primarily $Na_2S$. In a preferred embodiment of the invention, the feedstock is contacted with sodamide at a temperature and under a hydrogen partial pressure in the upper extremes of the temperature and hydrogen partial pressure ranges set out above in order to provide substantial desulfurization and demetallization while simultaneously subjecting a substantial portion of the hydrocarbon constituents of the feedstock to hydroconversion to lighter, lower boiling components.

DETAILED DESCRIPTION OF THE INVENTION

The process of this invention is generally applicable to any sulfur-bearing hydrocarbon feedstock. Thus, while the process is applicable to distillates, it is particularly effective when employed to treat heavy hydrocarbons, e.g., those containing residual oils. Preferably, therefore, the process of the invention is utilized for the treatment of whole or topped crude oils and residua. Crude oils obtained from any area of the world such as the Middle East, e.g., Safaniya, Arabian heavy, Iranian light, Gach Saran, Kuwait, etc., the U.S. or Venezuelan, e.g. Laquinillas, Tia Juana, Bachaquero, etc., as well as heavy gas oils, shale oils, tar sands or syncrude derived from tar sands, coal oils, and asphaltenes, can be treated by the process of this invention. Additionally, both atmospheric residuum (boiling above about 650° F) and vacuum residuum (boiling above about 1050° F) can be treated. Preferably, the feedstock is a sulfurbearing heavy hydrocarbon oil having at least about 10% of materials boiling above about 1050° F, more preferably at least about 25% of materials boiling above about 1050° F.

The feedstock may be directly introduced into a contacting zone for combined desulfurization and hydroconversion without pretreatment. It is desirable, however, to desalt the feedstock in order to prevent NaCl contamination of the sodium salt products of the desulfurization reaction. Desalting is well known in the refining industry and may be effected by the addition of small amounts of water to the feedstock to dissolve the salt followed by the use of electrical coalescers. The oil is then dehydrated by conventional means.

Sodamide can be blended into the feedstock in a granular form ranging from powders (100+ microns) to particles (14 to 35 mesh range). Powders are preferred however, in order to maximize reaction rate and minimize the need for mechanical agitation beyond the point of initial blending of powders and feedstock. The amount of sodamide employed generally may range from about 1 to about 20% by weight of the feedstock, and preferably from about 1 to about 10% by weight thereof, depending on the sulfur content of the feedstock. Thus, from about 1 to about 10 moles of sodamide per mole of sulfur in the feedstock, can be employed, and preferably from about 1 to about 5, and more preferably from about 2 to about 3 moles of sodamide per mole of feed sulfur.

A hydrogen-containing gas is introduced into the contacting zone as either pure hydrogen (for example, from a steam reforming process) or as a diluted hydrogen gas stream (for example, that from refinery discard streams, e.g., subsequent to hydrotreating processes, gas effluent from cat cracker or reformer light ends streams, naphtha reformer recycle hydrogen streams, and the like).

Contact of the sodamide, hydrogen and the feedstock is carried out at reaction conditions designed to maintain the bulk of the feedstock, and preferably substantially all of the feedstock in the liquid phase and to effect simultaneous desulfurization and hydroconversion of the feedstock. Thus, the reaction of the feedstock, sodamide and hydrogen can be carried out at a temperature within the range of from 400° F to about 2000° F, and under a hydrogen partial pressure within the range of from about 150 to about 5000 psig. In a preferred embodiment of the invention where it is desired to effect desulfurization and demetallization while simultaneously effecting substantial hydroconversion of heavy constituents of the feedstock to light, lower boiling components, the feedstock, sodamide and hydrogen are contacted at a temperature within the range of from about 500° to about 2000° F, and preferably within the range of from about 750° to about 1000° F, under a hydrogen partial pressure of within the range of from about 500 to about 5000 psig, and preferably within the range of from about 1000 to about 3000 psig. It thus will be noted that an increase in temperatures and an increase in hydrogen partial pressures allows increasing hydrogen consumption by the feedstock, with concomitant increasing product quality including increased demetallization, substantial desulfurization, a substantial reduction of Conradson carbon content and a substantial increase in API gravity.

Where it is desired to primarily desulfurize the feedstock without substantial hydroconversion thereof, the feedstock, sodamide, and hydrogen may be contacted at a temperature within the range of from about 400° to about 750° F and preferably within the range of from about 550° to about 750° F, and under a hydrogen pressure within the range of from about 150 to about 950 psig, and preferably within the range of from about 150 to about 750 psig.

Total system pressures may vary widely and will normally vary based on the feedstock to be treated, the reaction temperature, and the desired hydrogen partial pressure. Thus, for reduced crudes the minimum total pressure will be in the range of from about 35 to 300 psig. For whole or topped crudes, minimum total pressures may range from about 500 to 600 psig in order to maintain the feedstock substantially in the liquid phase.

The desulfurization and hydroconversion can be conducted as a batch or continuous type operation. The apparatus used in carrying out the desulfurization and hydroconversion is of a conventional nature and can comprise a single reactor or multiple reactors equipped with shed rows or other stationary devices to encourage contacting; orifice mixers; efficient stirring devices such as mechanical agitators, jets of restricted internal diameter, turbomixers, and the like; or a packed bed.

The hydrocarbon feedstock and the sodamide can be passed through one or more reactors in concurrent, crosscurrent, or countercurrent flow, etc. It is preferable that oxygen and water be excluded from the reaction zones; therefore, the reaction system is normally purged with dry nitrogen and the feedstock dried prior to introduction into the reactor. It is understood that trace amounts of water, i.e., less than about 0.5 weight percent, preferably less than about 0.1 weight percent based on total feed, can be present in the reactor. The resulting oil dispersion is subsequently removed from the desulfurization zone and resolved by conventional means.

The salt produced in the above reaction generally comprises sodium sulfide, or sodium hydrosulfide if hydrogen sulfide is employed to quench the reaction mixture. The salt product is conveniently separated from the desulfurized feedstock by filtration, centrifugation, decantation, etc.

DESCRIPTION OF THE DRAWINGS

The attached FIGURE is a flow diagram of a preferred embodiment of the overall desulfurization and hydroconversion process of the invention using sodamide and hydrogen.

Turning now to the accompanying FIGURE, a sulfur-containing feedstock, preheated to 450° to 500° F, is fed by means of line 1 and pump 2 to separator vessel 3 where trace amounts of water and light hydrocarbon fractions are removed through line 4. The feed is then discharged through line 5 by pump 6 to filter vessel 7 wherein particulate matter, i.e., coke, scale, etc., is removed.

The feed may be preliminarily desalted by conventional means (not shown). Feed exiting the filter via line 8 is split into two streams. A small portion is fed through line 9 and heat exchanger 14 to dispersator vessel 11 where a dispersion is formed with sodamide entering through line 67. The dispersator vessel is of a conventional design and is operated at 450° to 500° F at atmospheric pressure. The vessel is blanketed with hydrogen. The resultant dispersion, drawn through line 12, blends with the balance of the feed in line 10 and enters the charging pump 13, where the pressure is raised to about 500 psig. The feedstock will ordinarily be a whole crude of about 1 to about 3 weight percent sulfur based on total feed or a residual stock of about 2 to about 7 weight percent sulfur based on total feed.

The feedstock enters heat exchanger 16 via line 15 where its temperature is raised to from about 650° F to 850° F and is then fed through line 17 to reactor vessel 18. The reactor contains baffles 19 to promote continuing contact between sodamide and the oil and to prevent bypassing from the inlet to the outlet. Hydrogen is introduced into the reactor vessel 18 via line 74 in amounts such that the total partial pressure of hydrogen in the reactor ranges between about 500 and 3000 psig. Holding time in the reactor is about 15 to 60 minutes and is preferably 30 minutes. The temperature at the top of reactor 18 is about 830° F but can range as high as 900° F. Gas that is formed due to the increase in temperature and excess hydrogen is taken over-head through line 20 and is condensed and depressurized by conventional means (not shown). The desulfurized feedstock containing dispersed sodium sulfide and other salts leaves the top of reactor 18 via line 21.

The dispersion exits through line 21 at about 800° F and 1500 psig and is then passed to ammonia purge vessel 22, where the pressure is lowered to from 50 to 300 psig. Hydrogen gas is fed through line 23 into ammonia purge vessel 22 wherein it purges the ammonia, the ammonia and hydrogen and light hydrocarbons exiting vessel 22 through line 24. The hydrogen is then separated from the ammonia by conventional techniques and may be returned to the reactor vessel 18 while the ammonia may be employed to form sodamide.

Sodium sulfide-oil dispersion exiting vessel 22 via line 25 is introduced into contacting vessel 26 wherein the dispersion is contacted with 30–80 mole percent hydrogen sulfide (introduced into vessel 26 via line 27) based on the total moles of salts contained in the oil, at a temperature of between about 600° and 800° F, and preferably between about 625° and 750° F, e.g., 700° F, and at a pressure of between about 25 and 300 psig. Residence time in the contactor vessel is on the order of about 10 minutes, although longer or shorter times may be used if desired.

The $H_2S$-treated dispersion exits through line 28 at about 700° F, and 100 psig, and is then cooled to about 250° F, in heat exchanger 29. The mixture is then fed through line 30 to hydroclone vessels 31 and 32 in series. Desulfurized oil is withdrawn via line 33 to heat exchanger 34 and exits at about 250° to 300° F, through line 35. An acid, such as dilute sulfuric acid or acetic acid, may be injected into line 35 through line 36 to react with oil-soluble sodium salts, e.g., sodium mercaptides and the like, and the resultant mixture enters the electrostatic precipitator 37 via line 38. The acidic aqueous phase from vessel 3 is withdrawn through line 39 and discarded. Desulfurized oil is fed through line 40 to steam stripper **40*a* and subsequently to storage via line 41.**

Oil salt slurry drawn from the hydroclone vessels through lines 42 and 43 is fed to wash vessel 44 where a light hydrocarbon wash, entering through line 45 is used to remove heavy adhering oil. The wash effluent is drawn off through line 46 and is eventually fractionated to recover the desulfurized oil content and the light hydrocarbon. The wash vessel operates at 25 to 100 psig at temperatures of 150° to 300° F. A slurry of washed solids is fed through line 47 to drier 48 to remove light hydrocarbon, which is taken off through line 49.

Dry solids comprising sodium sulfur salts exiting via line 49 from drier 48 may then be converted to sodamide employing conventional procedures as will be apparent to those skilled in the art.

This invention is generally applicable to heavy crudes and residua feeds, including both the 650+° F and 1050° F+ fraction of feeds from Africa, North and South America and the Middle East. Inspection for the feedstock used in the examples is as follows:

FEEDSTOCK INSPECTION

| Feed Designation | Safaniya |
|---|---|
| API Gravity | 14.4 |
| Sulfur, Wt. % | 4.0 |
| Nitrogen, Wt. % | 0.3 |
| Carbon, Wt. % | 84.4 |
| Hydrogen, Wt. % | 11.1 |
| Oxygen, Wt. % | 0.3 |
| Conradson Carbon, Wt. % | 12.1 |
| Metals, ppm | |
| NI | 28 |
| V | 77 |
| Fe | 4 |
| | 101 |
| Viscosity | |
| VSF 122° F. | 235 |
| 144° F. | 131 |
| Pour Point, ° F | 33 |
| Naphtha Insolubles, Wt. % | 7 |

Sodamide treated oil products were analyzed not only for sulfur content, but also for changes in metals content and general physical properties, such as API gravity, and Conradson carbon.

EXAMPLES 1 to 3

The data shown in Table I demonstrates the effect of hydrogen pressure on desulfurization and hydroconversion of the above feed with sodamide.

TABLE I

THE EFFECT OF HYDROGEN PRESSURE (Batch Tests at 700° F for 2 hrs. - treatment of Safaniya Atmospheric Residuum Feed with 9.9% Sodamide based on weight of feed)

| Example No. | Control A | 1 | 2 | 3 |
|---|---|---|---|---|
| Residuum g. | 98.8 | 93.4 | 97.6 | 94.4 |
| Sodamide g. | 10.2 | 9.5 | 10.4 | 9.3 |
| Hydrogen psig | 0 | 200 | 500 | 500 (added at 400° F) |
| Residuum Product Analysis | | | | |
| Sulfur, Wt. % | 1.8 | 2.1 | 1.6 | 1.9 |
| Metals Ni/V/Fe(ppm) | 15/22/15 | 41/24/2 | 17/15/2 | 20/2/3 |
| Coke, Wt. % | 6 | 0.5 | 0 | 0 |
| Conradson Carbon, Wt. % | 5.8 | 10.1 | 9.1 | 9.2 |
| API Gravity | 19 | 18.1 | 20.3 | 19.7 |
| Desulfurization, % | 55 | 47.5 | 60 | 50.5 |

TABLE I-continued

THE EFFECT OF HYDROGEN PRESSURE (Batch Tests at 700° F for 2 hrs. - treatment of Safaniya Atmospheric Residuum Feed with 9.9% Sodamide based on weight of feed)

| Example No. | Control A | 1 | 2 | 3 |
|---|---|---|---|---|
| Demetallization, % | 53 | 39 | 66 | 77 |
| Conradson Carbon Removal % | 52 | 17 | 25 | 24 |

In comparing Examples 1 and 2, it is seen that process efficiency increases with higher hydrogen pressures, so as to obtain increased percent desulfurization, increased percent demetallization, increased percent Conradson carbon removal, increased API gravity, and decreased coke formation. As seen in Control A, where the process is carried out in the absence of hydrogen, appreciable coke formation and cracking result. Furthermore, Example 3 shows that hydrogen need not be present at the start of the run but can effectively control cracking and higher conversion if injected at a temperature below or equal to the melting point of the sodamide.

EXAMPLES 4 and 5

The data shown below in Table II demonstrate the effect of amounts of sodamide on combined desulfurization and hydroconversion.

TABLE II

THE EFFECT OF SODAMIDE CONCENTRATION (Batch tests at 700° F for 2 hrs. Hydrogen pressure 500 psig - Safaniya Atmospheric residuum feed)

| Example No. | 4 | 5 |
|---|---|---|
| Reactants | | |
| Residuum g. | 96.4 | 97.5 |
| Sodamide Wt. % feed | 5.5 | 9.9 |
| Hydrogen psig | 500 | 500 |
| Residuum Product Analysis | | |
| Sulfur, Wt. % | 2.3 | 1.3 |
| Metals Ni/V/Fe(ppm) | 0/17/3 | 8/10/7 |
| Coke, Wt. % | 0 | 0 |
| Conradson Carbon, Wt. % | 8.6 | 8.2 |
| API Gravity | 18.5 | 20.5 |
| Desulfurization, % | 42.5 | 68 |
| Demetallization, % | 82 | 77 |
| Conradson Carbon Removal, % | 29 | 31 |

It is seen from the data in Table II that process efficiency increases with higher sodamide concentrations, so as to obtain increased percent desulfurization, decreased Conradson carbon, and increased API gravity.

EXAMPLES 6 and 7

The data shown below in Table III demonstrate the effect of increased hydrogen pressure and operating temperature on desulfurization and hydroconversion of the above feed with sodamide.

TABLE III

THE EFFECT OF HYDROGEN PRESSURE AND OPERATING TEMPERATURE (Batch tests for 1 hr. - treatment of Safaniya Atmospheric residuum feed with sodamide)

| Example No. | 6 | 7 |
|---|---|---|
| Reactants | | |
| Residuum g. | 97.0 | 101.0 |
| Sodamide g. | 9.7 | 10.8 |
| Hydrogen Pressure psig | 500 | 1700 |
| Temperature ° F | 700 | 820 |
| Residuum Product Analysis | | |
| Sulfur, Wt. % | 1.4 | 0.6 |
| Metals Ni/V/Fe(ppm) | 7/15/2 | 2/0/1 |
| Coke, Wt. % | 0 | 0.8 |
| Conradson Carbon, Wt. % | 65 | 86 |
| API Gravity | 20.1 | 24.1 |
| Desulfurization, % | 65 | 86 |
| Demetallization, % | 76 | 97 |
| Conradson Carbon Removal, % | 27 | 61 |

In comparing Examples 6 and 7, it is seen that where higher hydrogen pressures and temperatures are employed, there is a substantial increase in hydroconversion as reflected by increased Conradson carbon removal and increased API gravity, and concomitant substantial increases in desulfurization and demetallization. Also, the product of Example 7 contains 80 Vol % 1050° F distillate as compared to 60 Vol % in the feed.

EXAMPLE 8

The data shown below in Table IV demonstrate the effect of reaction time on desulfurization and hydroconversion.

TABLE IV

THE EFFECT OF REACTION TIME (Batch tests at 700° F - treatment with Safaniya Atmospheric Residuum with 9.9% sodamide and 500 psig hydrogen)

| Example No. | 8 | 6 | 5 |
|---|---|---|---|
| Reactants | | | |
| Residuum g. | 96.7 | 97.0 | 97.5 |
| Sodamide g. | 9.5 | 9.7 | 9.9 |
| Hydrogen, psig | 500 | 500 | 500 |
| Reaction Period, hr. | 0.5 | 1 | 2 |
| Residuum Product Analysis | | | |
| Sulfur Wt. % | 1.3 | 1.4 | 1.3 |
| Metals Ni/V/Fe(ppm) | 4/29/1 | 7/15/2 | 8/10/7 |
| Coke Wt. % | 0 | 0 | 0 |
| Conradson Carbon, Wt. % | 8.5 | 8.8 | 8.2 |
| Desulfurization, % | 68 | 65 | 68 |
| Demetallization, % | 69 | 78 | 77 |
| Conradson Carbon Removal, % | 29.5 | 27 | 31 |

TABLE IV-continued

THE EFFECT OF REACTION TIME (Batch tests at 700° F - treatment with Safaniya Atmospheric Residuum with 9.9% sodamide and 500 psig hydrogen)

| Example No. | 8 | 6 | 5 |
|---|---|---|---|
| API Gravity | 20.8 | 20.1 | 20.5 |

As seen in Table IV, Examples 8, 6 and 5 demonstrate that the sodamide process of the invention is not particularly sensitive to reaction period, and a holding time or space velocity suited to the conversion level desired may be selected.

EXAMPLE 9

The data set out in Table V below demonstrate the effect of carrying out the process of the invention in a staged manner by successive treatments of the feed with fresh charges of sodamide and hydrogen.

TABLE V

THE EFFECT OF CARRYING OUT PROCESS WITH SAFANIYA ATMOSPHERIC RESIDUUM IN A STAGED MANNER

| Reactants | | Stage 1 | Stage 2 |
|---|---|---|---|
| Residuum g. | | 134.2 | 80.3 |
| Reagent, g., Wt. % | | $NaNH_2$, 13.4, 10.0 | $NaNH_2$, 3.0, 3.7 |
| Hydrogen, psig, | Initial | 500 | 500 |
| | Max. | 785 | 770 |
| | Final | 240 | 400 |
| $H_2$ Consumed, SCF/B | | 67 | 59 |
| Reaction Conditions | | | |
| Time, Hr. | | 1 | 1 |
| Temp., ° F. | | 700 | 700 |
| Product Inspections | | | |
| Sulfur, Wt. % | | 1.52 | 0.88 |
| Nitrogen, Wt. % | | — | 0.26 |
| Conradson Carbon, Wt. % | | — | 7.5 |
| Ni/V/Fe, ppm | | — | 9/9/9 |
| API Gravity | | 19.1 | 20.7 |
| Desulfurization, % | | 61.2 | 42.0 (overall 86.4%) |
| Conradson Carbon Loss, % | | — | 38.0 (overall 63.0%) |
| Demetallization, % | | — | 75.5 (overall 83.7%) |
| Products Recovered | | | |
| Liquid, Wt. % on Feed | | 94.7 | 95.6 |
| Coke. Wt. % on Feed | | 0.3 | 0.1 |
| $C_5$-Gas, Wt. on Feed | | 0.8 | 0.2 |

The data in Table V demonstrate that desulfurization can be increased by successive treatment of the feed with fresh charges of sodamide and hydrogen. This will be seen in comparing desulfurization of Example 6 (67%) with the desulfurization in stage 2 of Example 9 (86.4%).

What is claimed is:

1. A process for the simultaneous desulfurization and hydroconversion of a sulfur-containing petroleum oil feedstock, which comprises contacting said feedstock with sodamide in a reaction zone, in the presence of added hydrogen, said feedstock being maintained substantially in the liquid phase, to form an oil phase having a reduced sulfur and metals content, and reduced Conradson carbon content, and a salt phase.

2. The process of claim 1 wherein said reaction zone is maintained at a temperature within the range of from about 400° to about 2000° F.

3. The process of claim 2 wherein sufficient hydrogen is added to said reaction zone to provide a hydrogen partial pressure within the range of from about 150 to 5000 psig.

4. The process of claim 3 wherein said reaction zone is maintained at a temperature within the range of from about 400 to about 750° F, and wherein sufficient hydrogen is added to said reaction zone to provide a hydrogen partial pressure within the range of from about 150 to about 950 psig.

5. The process of claim 3 wherein said reaction zone is maintained at a temperature within the range of from about 750° to about 1000° F, and wherein sufficient hydrogen is added to said reaction zone to provide a hydrogen partial pressure within the range of from about 750 to about 3000 psig.

6. The process of claim 1 wherein the molar ratio of sodamide to the sulfur content of said feedstock is within the range of from about 2 to about 3 moles per mole of sulfur.

7. The process of claim 1 wherein said sodamide is present in an amount within the range of from about 1 to about 20% based on the weight of said feedstock.

8. The process of claim 1 wherein said salt phase comprises a sodium sulfur salt.

9. The process of claim 8 wherein said sodium sulfur salt comprises sodium sulfide.

10. The process of claim 8 wherein hydrogen sulfide is added to a mixture of said oil phase and salt phase to convert the sodium sulfur salt to sodium hydrosulfide.

11. The process of claim 1 including the step of recovering ammonia released from said reaction zone.

12. The process of claim 1 including the steps of separating said oil phase from said salt phase, said salt phase comprising a sodium sulfur salt.

13. The process of claim 12 including the step of converting said sodium sulfur salt to sodamide.

14. A process for simultaneously desulfurizing, demetallizing and hydrogenating a sulfur-containing heavy petroleum oil feedstock containing at least 10 wt.% of material boiling above about 1050° F which comprises contacting said feedstock, substantially in the liquid phase, with sodamide in a reaction zone at elevated temperature and pressure and in the presence of added hydrogen, to form an oil product having a sulfur, metals and Conradson carbon content lower than that of the feed.

15. The process of claim 14 wherein the molar ratio of sodamide to the sulfur content of the feedstock ranges from about 1–10 moles per mole of sulfur.

16. The process of claim 15 wherein the feedstock is selected from the group consisting essentially of whole crude oils, topped crude oils and residua.

17. The process of claim 16 wherein the reaction is carried out at a temperature ranging from about 500° F. to 2000° F. and at a hydrogen partial pressure ranging from about 500 to 5000 psig.

18. The process of claim 14 wherein the sodamide is present in an amount ranging from about 1–20 wt. % of the feed.

19. The process of claim 17 wherein the temperature and hydrogen partial pressure range from about 750°–1000° F. and 1000–3000 psig, respectively.

* * * * *